United States Patent [19]

Igarashi et al.

[11] Patent Number: 4,901,044

[45] Date of Patent: Feb. 13, 1990

[54] DISTRIBUTED-CONSTANT FILTER

[75] Inventors: Masao Igarashi; Isao Akiyama; Kazuhiro Kumagai, all of Takasaki; Yoshinobu Takeda, Gunma; Mamoru Yamaki, Gunma; Yoshiaki Iguchi, Gunma; Satoshi Kazama, Takasaki, all of Japan

[73] Assignee: Taiyo Yuden Co., Ltd., Tokyo, Japan

[21] Appl. No.: 293,945

[22] Filed: Jan. 5, 1989

[30] Foreign Application Priority Data

Jan. 13, 1988 [JP] Japan ..... 63-6253
Apr. 28, 1988 [JP] Japan ..... 63-108070

[51] Int. Cl.[4] ..... H01P 1/202

[52] U.S. Cl. ..... 333/207; 333/202; 333/223; 333/226

[58] Field of Search ..... 333/202, 203, 206, 207, 333/222, 223–226

[56] References Cited

U.S. PATENT DOCUMENTS 4,398,164 8/1983 Nishikawa et al. ..... 333/206
4,464,640 8/1984 Nishikawa et al. ..... 333/202
4,730,174 3/1988 Nishikawa et al. ..... 333/226

*Primary Examiner*—Eugene R. LaRoche
*Assistant Examiner*—Seung Ham
*Attorney, Agent, or Firm*—Woodcock Washburn Kurtz Mackiewicz & Norris

[57] ABSTRACT

A quarter-wave distributed-constant dielectric filter or resonator having a ceramic body which typically is composed principally of barium titanate. The ceramic filter body has one or more resonance holes extending therethrough. A conductive covering of silver or the like on the filter body has a portion formed on the surface defining each resonance hole. Mounted in each resonance hole is a prefabricated capacitor having a first terminal extending from within the resonance hole. The second terminal is electrically coupled to the conductive covering on the surface of the resonance hole. The capacitance of the capacitor or capacitors can be known before they are mounted to the filter body, so that the filter is readily manufacturable to exact electrical characteristics desired.

25 Claims, 13 Drawing Sheets

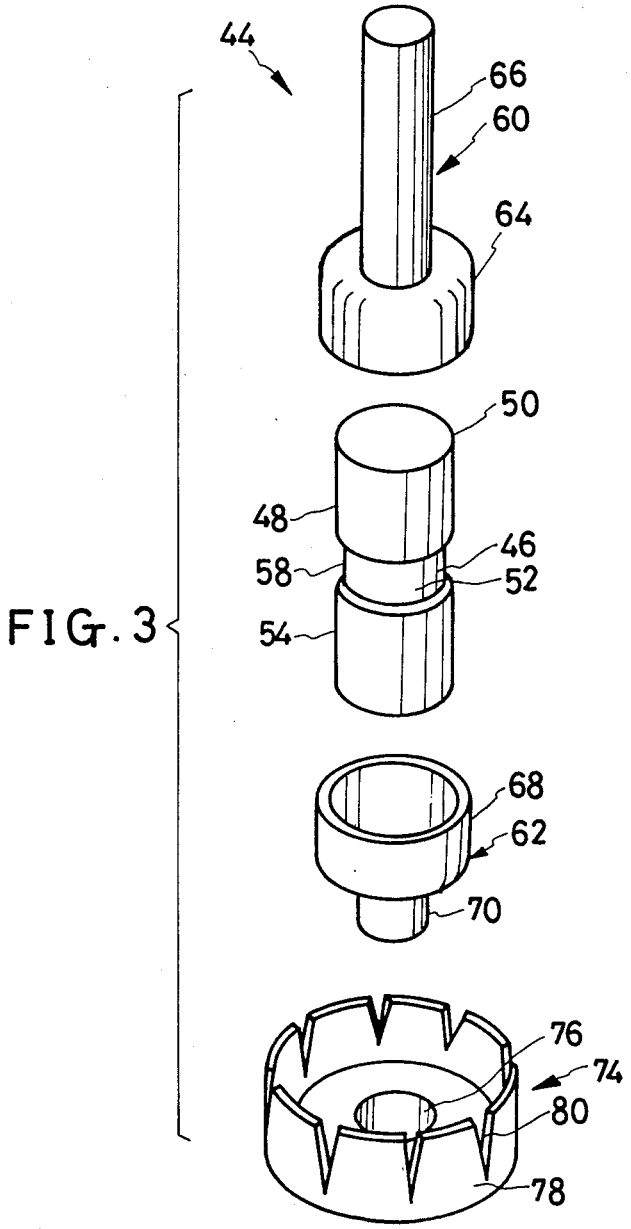
FIG. 3
FIG. 4
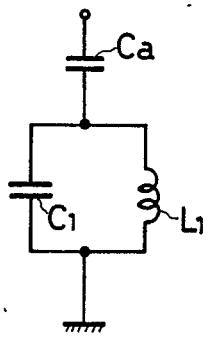

DISTRIBUTED-CONSTANT FILTER

BACKGROUND OF THE INVENTION

Our invention relates generally to filters or resonators, and more specifically to a distributed-constant filter or resonator of the class having a dielectric ceramic body. The device of our invention lends itself to use in communication equipment such as used for car telephone, citizens' radio service, cordless telephone, etc.

Quarter-wave distributed-constant filters find extensive usage in communication equipment. Although a variety of constructions have been suggested for this type of filter, Nishikawa et al. U.S. Pat. No. 4,464,640 represents an example that we believe is most pertinent to our invention. This prior art device is such that a dielectric body of cylindrical shape, with a lead wire extending axially therethrough, is inserted in each of two or more resonance holes formed in a block of dielectric ceramic material. Capacitive coupling is provided between the lead wires and the electroconductive layers on the surfaces of the ceramic block defining the resonance holes.

Basically, we favor this prior art filter because of the simplicity of construction. We do, however, object to the unavoidable fluctuations in the performance characteristics of filters actually manufactured on the fundamental construction described previously. Such fluctuations are unavoidable because the dielectric bodies of plastic or ceramic material are not usually fabricated to very close dimensional tolerances.

SUMMARY OF THE INVENTION

We have hereby invented a novel distributed-constant filter or resonator that is readily manufacturable to desired electrical characteristics.

Briefly, the distributed-constant filter or resonator of our invention comprises a dielectric filter body with at least one resonance hole extending therethrough. The filter body has formed thereon a conductive covering which includes an inner portion covering the inside surface of the filter body defining the resonance hole. At least partly received in the resonance hole in the filter body is a prefabricated capacitor comprising a first and a second electrode on a dielectric capacitor body. The capacitor further comprises first terminal means connected to the first electrode and having a lead at least partly disposed outwardly of the resonance hole, and second terminal means connected to the second electrode and disposed in the resonance hole. Also included in the filter of our invention are connector means disposed in the resoance hole and electrically connecting the second terminal means of the capacitor to the inner portion of the conductive covering on the filter body.

The above summarized device of our invention features the fact that the capacitor or capacitors to be mounted in the resonance hole or holes in the filter body are completed before they are mounted in place. Thus, since the capacitance of the capacitor or capacitors can be known before the filter is completed, it becomes easy to manufacture filters of desired electrical characteristics.

It will also be appreciated that the prefabricated capacitor or capacitors can be readily mounted to the filter body, all that is required being to insert the capacitor or capacitors in the resonance hole or holes and to connect their second terminal means to the conductive covering on the filter body. While the connector means may take various forms in practice, the second terminal means are readily connectable to the conductive covering as this covering has a portion formed on the surface of the resonance hole or holes receiving the second terminal means.

The above and other features and advantages of our invention and the manner of realizing them will become more apparent, and the invention itself will best be understood, from a study of the following description and appended claims, with reference had to the attached drawings showing several preferable embodiments of our invention.

BRIEF DESCRIPTION OF THE DRAWINGS

FIG. 3 is an enlarged, exploded perspective view of the capacitor used in the FIGS. 1 and 2 filter, the capacitor being shown together with the connector connecting the second capacitor terminal to the conductive covering on the filter body;

FIG. 4 is a schematic diagram of an electric circuit equivalent to the FIGS. 1 and 2 filter;

DESCRIPTION OF THE PREFERRED EMBODIMENTS

Figure 1:
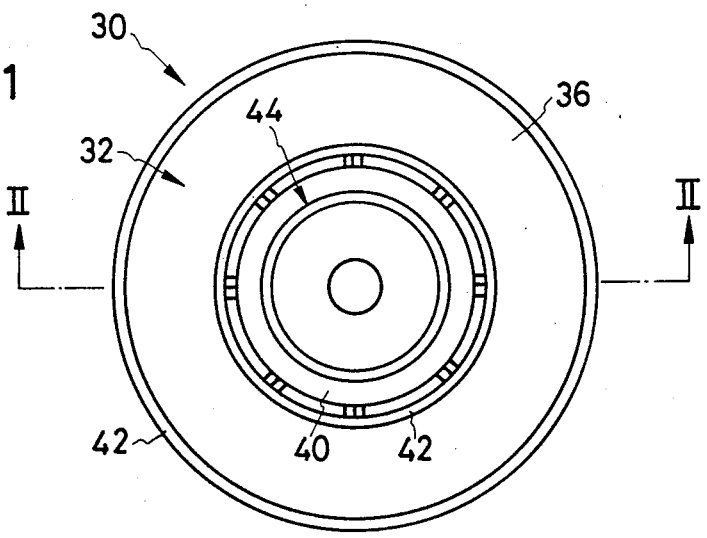
FIG. 1 is a top plan of the distributed-constant filter constructed in accordance with the novel concepts of our invention.
Figure 2:
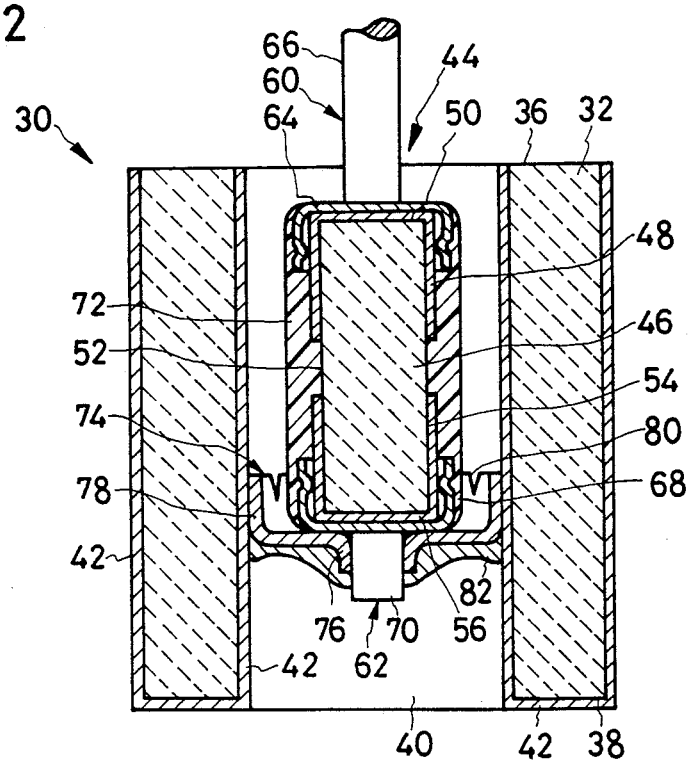
FIG. 2 is an axial section through the FIG. 1 filter, taken along the line II—II in FIG. 1.

We will now describe our invention in detail as embodied in the filter 30 of FIGS. 1 and 2. This filter is a quarter-wave distributed-constant dielectric ceramic resonator, having a cylindrical dielectric body 32 of a ceramic material composed principally of barium titanate. The dielectric filter body 32 has a pair of opposite end faces 36 and 38, with a resonance hole 40 extending therebetween in coaxial relation to the filter body.

A conductive covering 42 is formed on both inside and outside surfaces, as well as the bottom end face 38, of the tubular filter body 32. Only the top end face 36 of the filter body 32 is left exposed. Typically, the conductive covering 42 may be formed by coating a silver paste on the required surfaces of the filter body 32 and by subsequently baking the coating.

Mounted in the resonance hole 40 in the filter body 32 is a prefabricated coupling capacitor 44 illustrated in axial section in FIG. 2. FIG. 3 also shows only the capacitor 44 in enlarged and exploded perspective. It will be noted from these figures that the capacitor 44 has a dielectric ceramic body 46 disposed coaxially with the filter body 32. An electrode 48, in the shape of a tube closed at one end, is fitted over the top end 50, as well as the neighboring part of the surface 52, of the capacitor body 46. Another electrode 54 of similar shape is fitted over the bottom end 56, as well as the neighboring part of the surface 52, of the capacitor body 46.

As indicated in FIG. 3, the opposed ends of the two electrodes 48 and 54 have a spacing 58 therebetween. The electrostatic capacitance between the electrodes 48 and 54 is inversely proportional to the spacing 58. We recommend that the electrodes 48 and 54 be formed by plating a suitable metal over the entire surfaces 50, 52 and 56 of the capacitor body 46 and then by grinding off the midportion of the plating to create the spacing 58. The dimension of the spacing 58 parallel to the axis of the capacitor body 46, and therefore the capacitance offered by the electrodes 48 and 54, are readily adjustable by varying the width to which the metal plating on the capacitor body is ground off.

The capacitor 44 further comprises a pair of terminals 60 and 62 in electrical contact with the pair of electrodes 48 and 54, respectively. The first or top terminal 60 comprises a metal cap 64 fitted over the top electrode 48, and a lead wire 66 soldered to the metal cap and extending from within the resonance hole 40 beyond the plane of the top end face 36 of the filter body 32.

We suggest that the metal cap 64 be both self-biased into firm engagement with the top electrode 48 and soldered thereto. The soldering of the metal cap to the top electrode will be easy by preforming a solder plating on the metal cap and by heating the metal cap, and so melting the solder, after the metal cap has been pressfitted over the top electrode.

The second or bottom terminal 62 likewise comprises a metal cap 68 fitted over the bottom electrode 54, and a lead wire 70 welded to the metal cap 68. The bottom terminal metal cap 68 can be coupled to the bottom electrode 54 in the same way as the top terminal metal cap 64 is to the top electrode 48. The bottom terminal lead wire 70 is disposed collinearly with the top terminal lead wire 66 and is short enough to be wholly received in the resonance hole 40.

As indicated in FIG. 2, a plastic molding 72 encases all but the leads 66 and 70, and parts of the metal caps 64 and 68, of the capacitor 44.

A metal-made connector 74 electrically connects the bottom terminal 62 to the conductive covering 42 on the inside surface of the filter body 32. We have shown the connector 74 of this particular embodiment as a one-piece construction of a relatively small diameter tubular portion 76 and a larger diameter tubular portion 78 in concentric arrangement. The smaller diameter portion 76 is closely fitted over the bottom terminal lead wire 70. Made resilient by having notches 80 cut therein at constant angular spacings, the larger diameter portion 78 is pressfitted in the resonance hole 40 for contact with the conductive covering 42. The connector 74 may further be soldered as at 82 to the conductive covering 42 and to the bottom terminal 62. We recommend the coating of a solder paste on the required parts of the connector 74. The solder paste may be fused after mounting the connector 74 in place.

We understand that, in use, the filter 30 is enclosed in a grounded metal casing, not shown. This unshown casing is to be electrically connected to the conduc covering 42 on the filter body 32. Typically, the dielectric filter body 32 has an axial dimension of 10.0 millimeters (mm), an outside diameter of 6.0 mm, and an inside diameter of 2.8 mm.

FIG. 4 is a diagram of an electric circuit equivalent to the dielectric filter 30. The resonance circuit comprising capacitance C1 and inductance L1 is constituted of the conductive covering 42 on the filter body 32. The coupling capacitance Ca at the input stage corresponds to the capacitor 44 in the resonance hole 40.

Constructed as in the foregoing, the distributed-constant filter 30 of our invention gains the following advantages:

1. The capacitance of the coupling capacitor 44 can be known before it is mounted in place on the filter body 32, the capacitor being prefabricated instead of being fabricated in place on the filter body. Therefore, in the manufacture of filters in accordance with our invention, only those prefabricated capacitors may be employed which have the desired capacitance values. Experiment has proved that the yield of the dielectric filters of the desired capacitance values can be improved to approximately 80% in accordance with our invention.

2. The capacitance of the coupling capacitor 44 is readily adjustable by varying the spacing 58 between the pair of electrodes 48 and 54 on the opposite ends of the capacitor body 46.

3. The coaxial arrangement of the capacitor 44 within the filter body 32 makes it easy to connect the bottom terminal 62 to the conductive covering 42 on the filter body 32 via the connector 74.

4. The resiliency of the connector 74 contributes to the ready and positive connection of the capacitor bottom terminal 62 to the conductive covering 42.

5. The metal caps 64 and 68 of the capacitor terminals 60 and 62 afford firm connection of the capacitor body 46 to the leads 66 and 70.

6. The resonance frequency is readily variable as the coupling capacitor 44 is displaced axially of the filter body 32 within the resonance hole 40.

Embodiment of FIGS. 5–8

Figure 5:
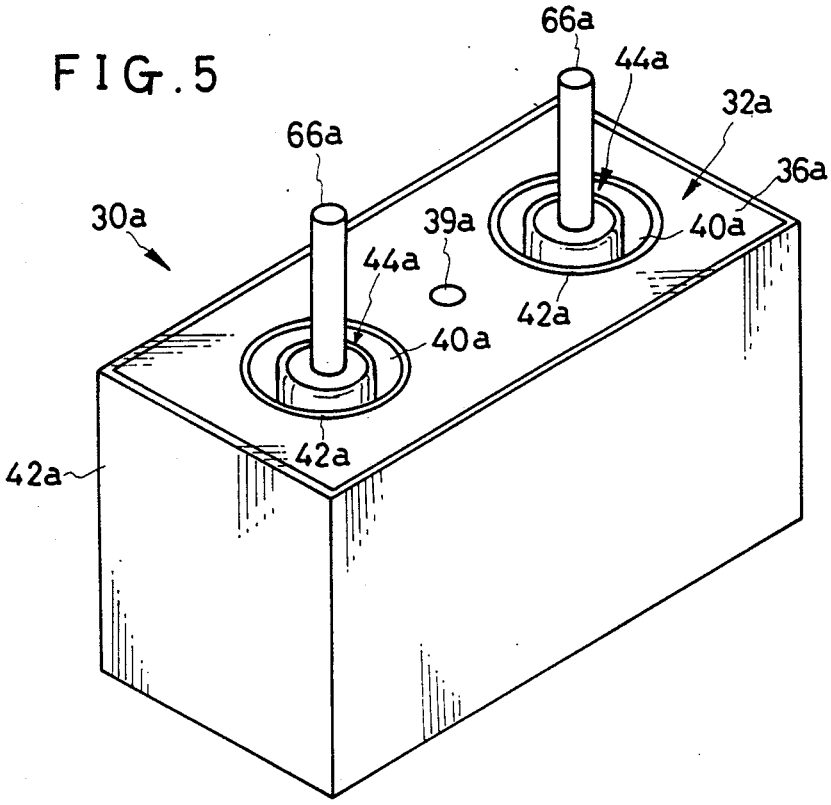
FIG. 5 is a perspective view of another preferred form of filter of our invention.
Figure 6:
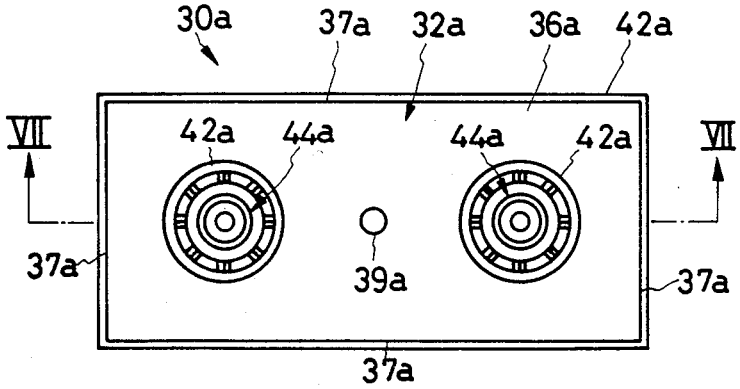
FIG. 6 is a top plan of the FIG. 5 filter.
Figure 7:
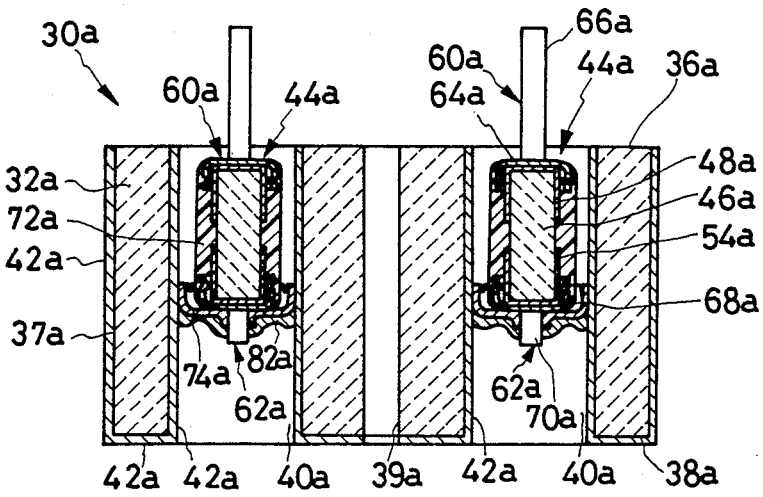
FIG. 7 is a section through the FIGS. 5 and 6 filter, taken along the line VII—VII in FIG. 6.

FIGS. 5–7 illustrate another preferred form of quarter-wave distributed-constant dielectric filter 30*a* in accordance with our invention. The filter 30*a* has a dielectric body 32*a* in the shape of a box having a pair of opposite end faces 36*a* and 38*a* and four side faces 37*a*. A pair of resonance holes 40*a* extend between the end faces 36*a* and 38*a* in parallel spaced relation to each other. Positioned intermediate the two resonance holes 40*a*, a coupling hole 39*a* also extends between the end faces 36*a* and 38*a*. A grounded conductive covering 42*a* covers all but the top end face 36*a*, and the surface bounding the coupling hole 39*a*, of the filter body 32*a*.

Mounted in the respective resonance holes 40*a* are a pair of prefabricated coupling capacitors 44*a* which are each of the same construction as the coupling capacitor 44 of the FIGS. 1–4 filter 30. Thus each coupling capacitor 44*a* comprises a dielectric body 46*a* of cylindrical shape, and a pair of electrodes 48*a* and 54*a* on the opposite ends of the filter body 46*a*, a pair of terminals 60*a* and 62*a* in electrical contact with the respective electrodes 48*a* and 54*a*, and a molded plastic enclosure 72*a* enveloping the required parts of the capacitor.

The top terminal 60*a* of each coupling capacitor 44*a* comprises a metal cap 64*a* and a lead wire 66*a*. The bottom terminal 62*a* comprises a metal cap 68*a* and a lead wire 70*a*. The top terminal lead 66*a* extends outwardly of one associated resonance hole 44*a*. Shorter than the top terminal lead 66*a*, the bottom terminal lead 70*a* is wholly disposed in the resonance hole 44*a*. A metal-made connector 74*a* connects the bottom terminal 62*a* to the conductive covering 42*a* via the solder 82*a*.

Typically, the filter body 32*a* is sized 10.0 mm (height) by 13.0 by 6.0. The diameter of each resonance hole 40*a* is 2.8 mm, and that of the coupling hole 39*a* is 1.3 mm.

Figure 8:
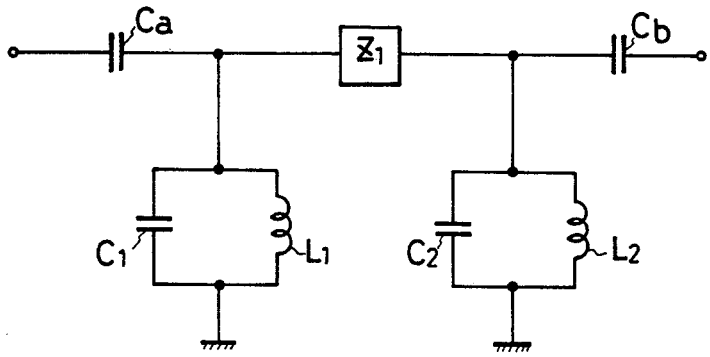
FIG. 8 is a schematic electrical diagram of an electric circuit equivalent to the FIGS. 5–7 filter.

FIG. 8 represents an electric circuit equivalent to the filter 30*a*. The two resonance circuits comprising capacitors C1 and C2 and inductors L1 and L2 are constituted of the dielectric body 32*a* and the grounded conductive covering 42*a* thereon. An inductive impedance Z1 interconnects the two resonance circuits. The coupling hole 39*a* contributes to the creation of the inductive impedance Z1. The pair of capacitors 44*a* provide input coupling capacitance Ca and output coupling capacitance Cb, so that the leads 66*a* of these capacitors function not only as such but also as terminals for connection of the filter 30*a* to other circuits.

The filter 30*a* comprising the two resonators is essentially equivalent in consturction to the FIGS. 1–4 filter 30. Thus the filter 30*a* gains the same advantages as set forth in connection with the filter 30.

Embodiment of FIGS. 9–15

Figure 9:
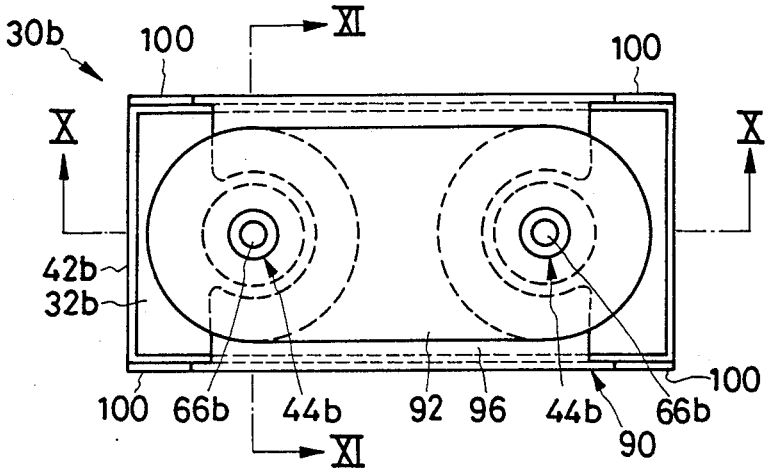
FIG. 9 is a top plan of a further preferred form of filter of our invention.
Figure 10:
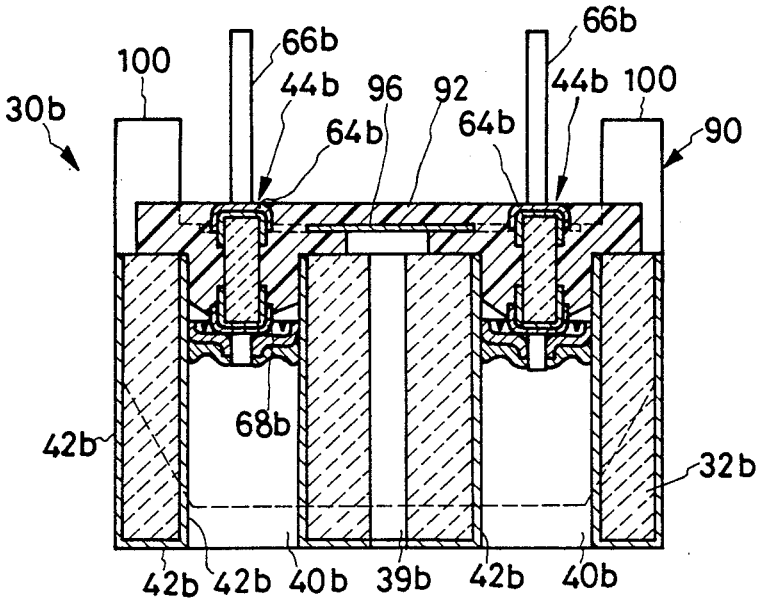
FIG. 10 is a section through the FIG. 9 filter, taken along the line X—X in FIG. 9.
Figure 11:
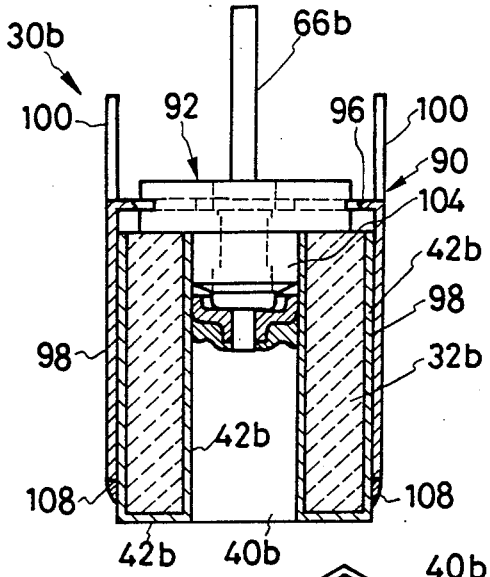
FIG. 11 is also a section through the FIG. 9 filter, taken along the line XI—XI in FIG. 9.
Figure 12:
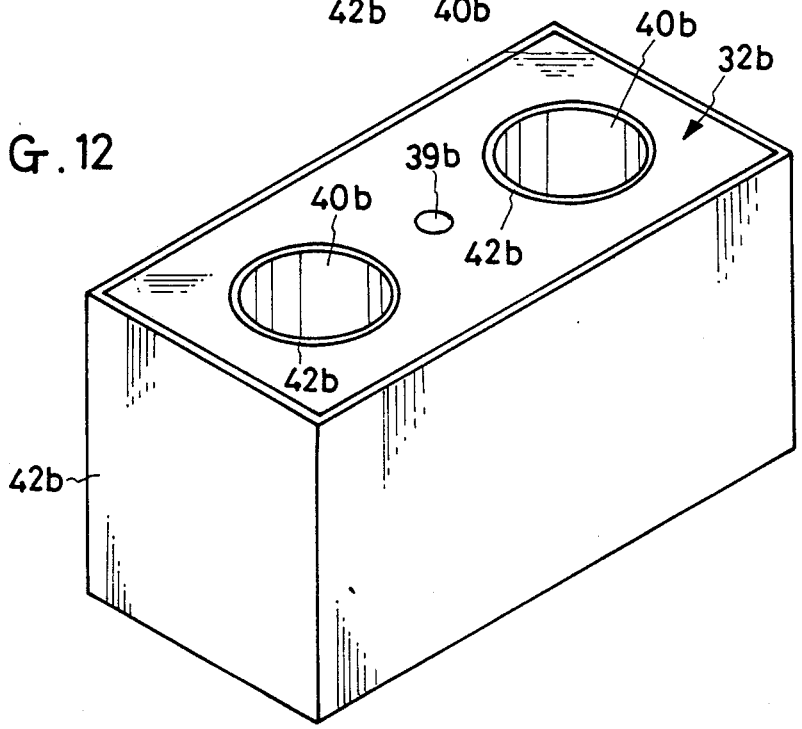
FIG. 12 is an enlarged perspective view of the filter body, with the conductive covering formed thereon, of the FIGS. 9–11 filter.

The distributed-constant filter 30*b* shown in FIGS. 9–11 also comprises a dielectric body 32*b* with a conductive covering 42*b* thereon, and two coupling capacitors 44*b* mounted one in each resonance hole 40*b* in the filter body. Basically, this filter 30*b* is akin in construction and operation to the FIGS. 5–8 filter 30*a*.

Figure 13:
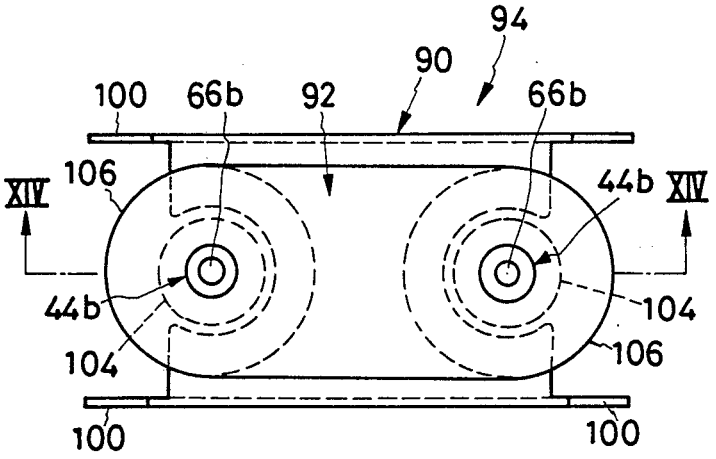
FIG. 13 is a top plan of the assembly of the capacitors and metal-made shield of the FIGS. 9–11 filter.
Figure 14:
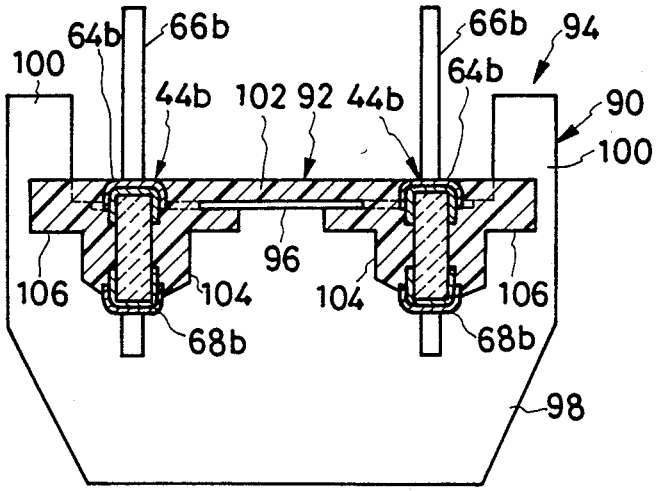
FIG. 14 is a section through the FIG. 13 assembly, taken along the line XIV—XIV in FIG. 13.

However, in the filter 30*b*, the two coupling capacitors 44*b* are integrally combined with a metal-made shield 90 via an insulating support 92 which is molded from a thermoplastic. The insulating support 92 may be molded in one piece with the coupling capacitors 44*b* and metal shield 90 before the capacitors are mounted to the filter body 32*b*. FIGS. 13 and 14 illustrate the one-piece assembly 94 of the coupling capacitors 44*b*, metal shield 90 and insulating support 92.

Figure 15:
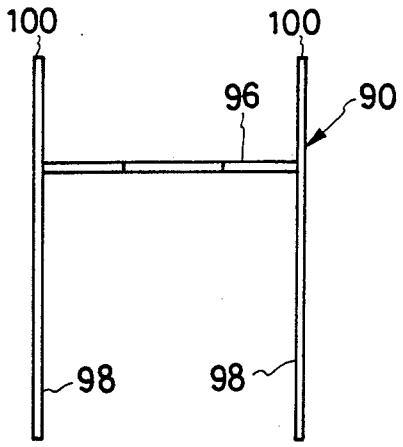
FIG. 15 is an elevation of the shield of the FIGS. 9–11 filter.

As will be understood from FIG. 15, taken together with FIGS. 13 and 14, the metal shield 90 comprises a web 96 overlying the coupling hole 39*b* and the neighborhoods of the resonance holes 40*b*, a pair of side flanges 98 depending from the opposite sides of the web 96 to be held against those parts of the conductive covering 42*b* which are on the longer side faces of the filter body 32*b*, and four upstanding lugs 100 for use in mounting the filter 30*b* to a circuit board, not shown, and as grounding terminals. The web 96 is secured to the insulating support 92.

FIG. 14 best indicates that the insulating support 92 comprises a flat major portion 102 interconnecting the two coupling capacitors 44*b*, a pair of depending bosses 104 for determination of the radial positions of the coupling capacitors in the resonance holes 40*b*, and a pair of flanges 106 for determination of the axial positions of the coupling capacitors in the resonance holes. The insulating support 92 envelopes all but the leads 66*b* and parts of the metal caps 64*b* and 68*b* of the coupling capacitors 44*b*.

In assembling the filter 30*b* of FIGS. 9–11 the assembly 94 of the coupling capacitors 44*b*, metal shield 90 and insulating support 92 may be mounted to the filter body 32*b* having the conductive covering 42*b* preformed thereon. The depending bosses 104 of the insulating support 92, which envelope the coupling capacitors 44*b*, are shaped and sized to fit in the resonance holes 40*b* in the filter body 32*b*. Therefore, these bosses may be readily inserted in the resonance holes 40*b*, to a depth determined by the thickness of the insulating support flanges 106 resting on the top of the filter body 32*b*. It is thus seen that the coupling capacitors 44*b* can be readily mounted in position on the filter body 32*b*.

As best illustrated in FIG. 11, the pair of side flanges 98 of the metal shield 90 have the spacing therebetween so determined as to be closely held against those parts of the conductive covering 42*b* which are on the longer sides of the filter body 32*b*. The mounting of the metal shield 90 is made easier by the fact that the metal shield 90 permits some resilient displacement of the side flanges 98 away from each other when they are being fitted over the filter body 32*b*. Preferably, and as indicated at 108 in FIG. 11, the metal shield 90 may be soldered to the conductive covering 42*b* for positive mechanical and electrical connection thereto. So mounted to the filter body 32*b*, the coupling capacitors 44*b* are electrically coupled to the conductive covering 42*b* in the same way as in the two foregoing disclosed filters 30 and 30*a*.

For mounting the thus completed filter 30*b* to an un shown circuit board, the lugs 100 of the metal shield 90 may be inserted in associated holes in the circuit board and grounded. The leads 66*b* may be connected to the signal lines on the circuit board.

The filter 30*b* possesses the following advantages, in addition to those set forth in conjunction with the filters 30 and 30*a*:

1. The two coupling capacitors 44*b* and the shield 90 are combined into the single assembly 94 via the insulating support 92. The assemblage of the filter 30*b* is thus made materially easier with the reduction of the number of parts that must be put together.

2. The two coupling capacitors 44b, as well as the leads 66b, can be maintained in exact positions relative to each other as the capacitors are supported by the metal shield 90 capable of manufacture to close dimensional tolerances.

3. As the leads 66b are held with little or no variations in the spacing therebetween, fluctuations in the electrical characteristics of the filter are reduced to a minimum.

4. The shield 90, being configured to fit over the top and pair of opposite sides of the filter body 32b, is readily manufacturable as by cutting and bending of sheet metal and is readily mountable to the filter body.

Figure 16:
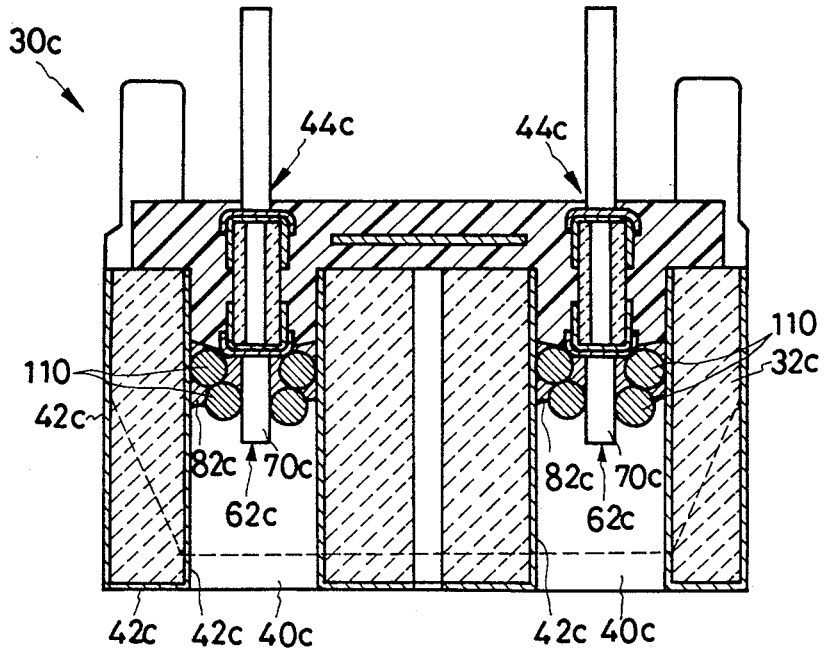
FIG. 16 is a view similar to FIG. 10 but showing a further preferred form of filter of our invention.

Embodiment of FIG. 16

The filter 30c shown in FIG. 16 is analogous in construction with the FIGS. 9–15 filter 30b except that in this filter 30c, the bottom terminals 62c of the two coupling capacitors 44c are electrically coupled to the conductive covering 42c on the filter body 32c via conductive grains 110 which are typically made of copper. The size of the conductive grains 110 may be determined so as to be filled in the annular spaces around the bottom leads 70c within the resonance holes 40c and may normally range from approximately 0.2 to 1.0 mm.

For connecting the capacitor bottom terminals 62c to the conductive covering 42c via the conductive grains 110, the filter body 32c may first be placed upside down, and a required number of conductive grains may be charged into the resonance holes 40c together with a solder paste. Then the solder paste may be heated and allowed to solidify thereby electrically connecting the capacitor bottom terminals 62c to the conductive covering 42c via the solder 82c itself and the conductive grains 110.

This filter 30c has the advantage, in addition to those enumerated in connection with the FIGS. 9–15 filter 30b, of the ease with which the capacitor bottom terminals 62c can be electrically coupled to the conductive covering 42c on the filter body 32c. The same method of connection by conductive grains is, of course, applicable to the FIGS. 1–4 filter 30 having but one resonance hole 40.

Figure 17:
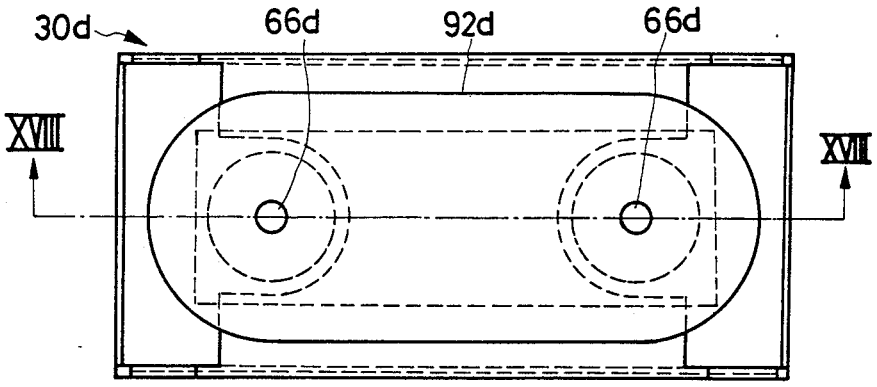
FIG. 17 is a top plan of a further preferred form of filter of our invention.
Figure 18:
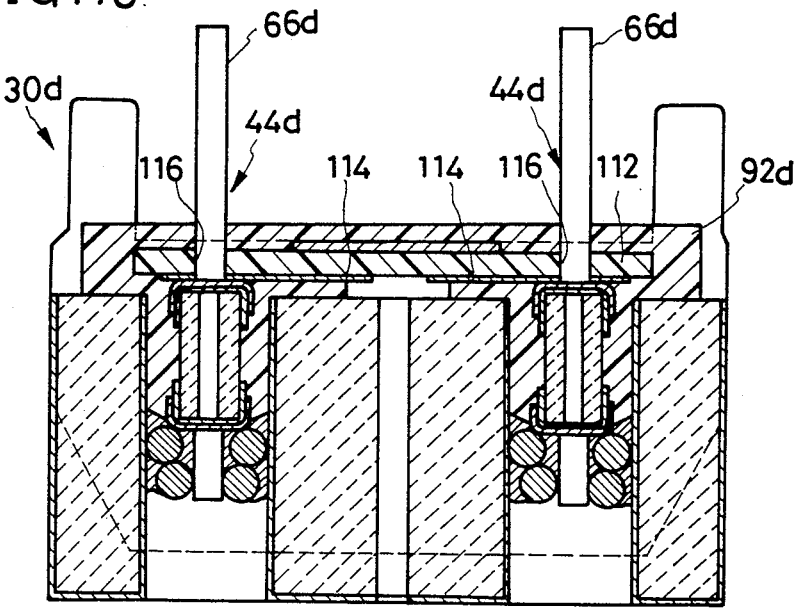
FIG. 18 is a section through the FIG. 17 filter, taken along the line XVIII—XVIII in FIG. 17.

Embodiment of FIGS. 17–18

The filter 30d of FIGS. 17 and 18 is similar in construction to the FIG. 16 filter 30c except that the filter 30d additionally comprises an insulating circuit board 112. This circuit board is provided with a pair of spaced-apart conductive layers 114 to provide capacitance between the input and output leads 66d. The circuit board 112 has formed therein two holes 116 through which extend the leads 66d. Consequently, the positional relationship between the pair of capacitors 44d can be determined by the circuit board 112 before they are integrally combined by the insulating support 92d. The insulating support 92d envelopes the circuit board 112 and the conductive layers 114 except the space between the conductive layers. The capacitance offered by the space between the conductive layers 114 contributes to the improvement of the frequency selectivity of the filter 30d.

Figure 19:
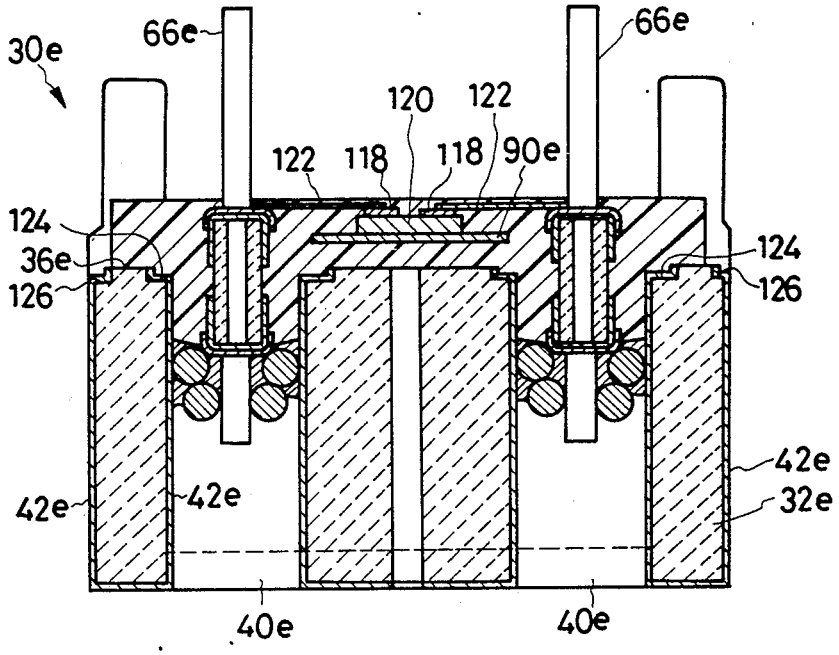
FIG. 19 is a view similar to FIG. 18 but showing a further preferred form of filter of our invention.

Embodiment of FIG. 19

In FIG. 19 is shown a slight modification of the FIGS. 17–18 filter 30d. The modified filter 30e features a capacitive element formed by a pair of electrodes 118 on a dielectric ceramic baseplate 120. The capacitive element is disposed on the metal shield 90e for capacitively coupling the pair of leads 66e, and the electrodes 118 are electrically connected to the leads 66e via sheet-metal connectors 122.

Additionally, in this filter 30e, the top end of each resonance hole 40e has an annular recess 124, and the outer edges of the top end face of the filter 32e is also recessed at 126. The conductive covering 42e is formed also on the surfaces defining the recesses 124 and 126. The creation of the additional conductive covering on parts of the top end face 36e serves the purpose of increasing the dielectric constant of the dielectric body 32e and, stated conversely, of decreasing the length of the resonance holes 40e and, in consequence, the height of the filter body 32e.

The additional conductive covering is formed in this embodiment on the surfaces defining the recesses 124 and 126 because this method makes it possible to accurately determine the areas on which the additional covering is to be formed. The additional conductive covering may first be formed, as by coating or plating, on the entire top end face 36e of the filter body 32e or beyond the boundaries of the recesses 124 and 126. Then the top end face 36e may be ground, leaving the additional conductive covering only on the surfaces defining the recesses 124 and 126.

Figure 20:
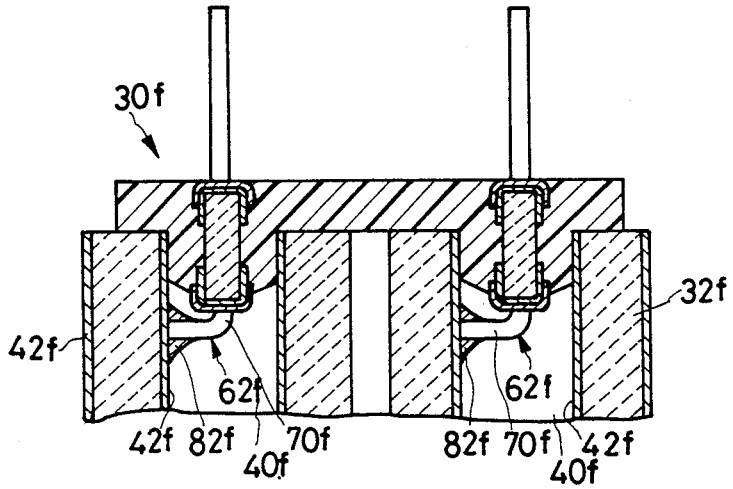
FIG. 20 is a partial section through a further preferred form of filter of our invention.

Embodiment of FIG. 20

The filter 30f of FIG. 20 is analogous in construction with the FIGS. 9–15 filter 30b except for the absence of the metal-made shield 90. This filter 30f may therefore be put to use with a separate shield.

The filter 30f also differs from the FIGS. 9–15 embodiment in the method of connecting the capacitor bottom terminals 62f to the conductive covering 42f on the filter body 32f. The bottom terminal leads 70f of the filter 30f are bent right-angularly and soldered directly at 82f to the conductive covering 42f within the resonance holes 40f. The capacitor bottom terminals can be connected to the conductive covering no less easily and positively than by the other methods disclosed in the foregoing.

Figure 21:
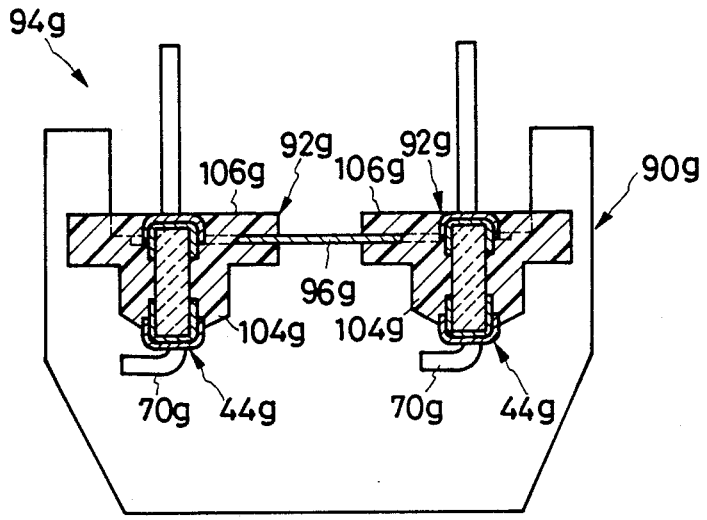
FIG. 21 is a section through the assembly of capacitors and metal-made shield of a further preferred form of filter of our invention.

Embodiment of FIG. 21

FIG. 21 shows a modification 94g of the FIG. 14 assembly 94 of the coupling capacitors 44b, metal shield 90 and insulating support 92. The modified assembly 94g differs from the assembly 94 in having no flat major portion 102 of the insulating support. Thus, in the modified assembly 94g, the insulating support is divided into two discrete portions 92g each comprising a boss 104g and a flange 106g. The two capacitors 44g and the discrete insulating supports 92g are joined in the prescribed relative positions solely by the web 96g of the metal-made shield 90g. The capacitor bottom terminal leads 70g are bent right-angularly for connection to the conductive covering on the filter body as in the FIG. 20 filter 30f.

Figure 22:
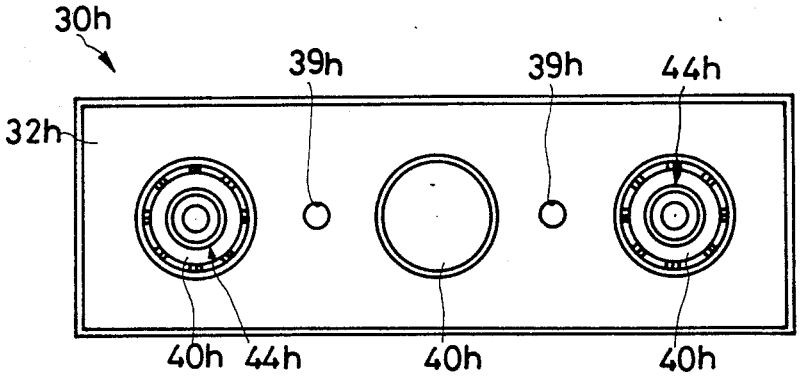
FIG. 22 is a top plan of a further preferred form of filter of our invention.
Figure 23:
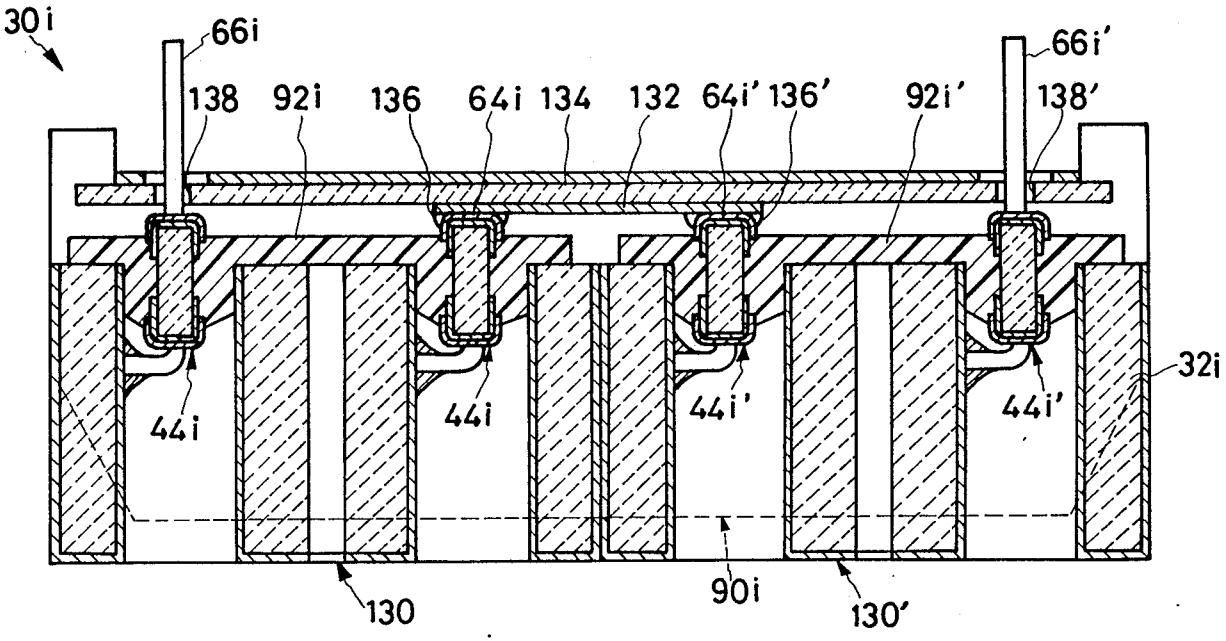
FIG. 23 is a section through a further preferred form of filter of our invention.

Embodiment of FIG. 22

The filter 30h seen in FIG. 22 has three resonance holes 40h and two coupling holes 39h formed in a filter body 32h but is similar in fundamental construction to the FIGS. 5–8 filter 30a. The three resonance holes 40h are arranged in a row, and two coupling capacitors 44h are mounted one in each of the two outer holes 40h. The filter 30h with the three resonator stages offers the same advantages as set forth in reference to the foregoing embodiments.

Embodiment of FIGS. 23–26

The filter 30i of FIGS. 23–26 is essentially a combination of two filters 130 and 130', each constructed like the FIG. 20 filter 30f, in side-by-side arrangement. The output capacitor 44i of the first filter 130 and the input capacitor 44i' of the second filter 130' have no top leads. Also, the output capacitor 44i of the first filter 130 and the input capacitor 44i' of the second filter 130' are interconnected by a conductive layer 132 on a ceramic baseplate 134 by having their metal caps 64i and 64i' soldered at 136 and 136' to the conductive layer 132.

The metal-made shield 90i of the filter 30i is secured to the insulating baseplate 134 instead of being formed in one piece with the insulating supports 92i and 92i'. The insulating baseplate 134 has formed therein two holes 138 and 138' for the insertion of the input leads 66i and 66i'.

Figure 24:
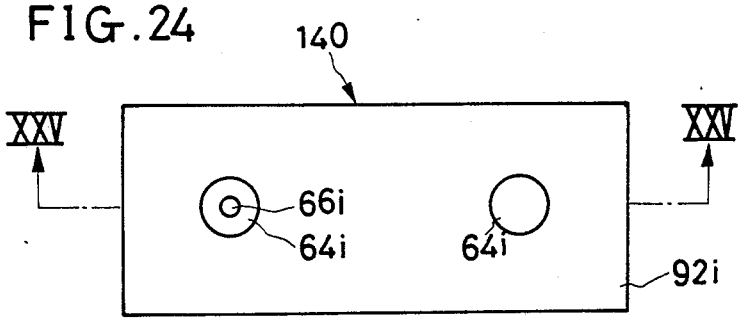
FIG. 24 is a top plan of one of the capacitor assemblies of the FIG. 23 filter.
Figure 25:
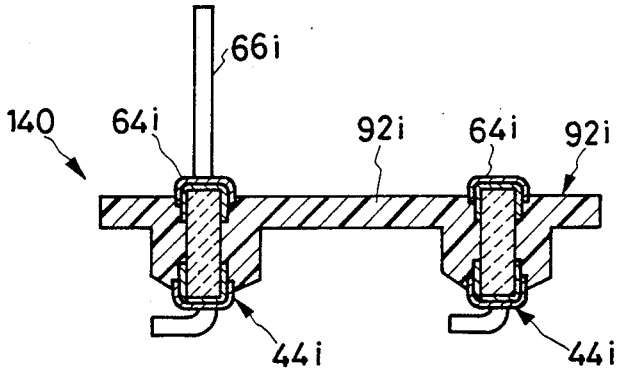
FIG. 25 is a section through the FIG. 24 capacitor assembly, taken along the line XXV—XXV in FIG. 24.
Figure 26:
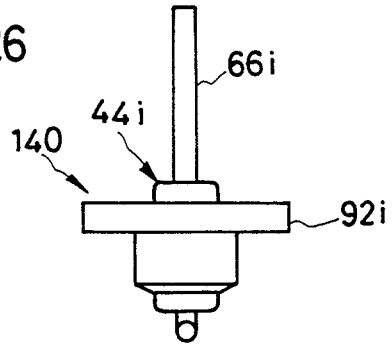
FIG. 26 is a left hand side elevation of the FIGS. 24 and 25 capacitor assembly.

In assembling the filter 30i there may first be prepared an assembly 140, FIGS. 24–26, of the two coupling capacitors 44i of the first filter 130 integrally combined with the insulating support 92i. Another similar assembly, not shown, may also be prepared in which the two coupling capacitors 44i' of the second filter 130' are combined with the insulating support 92i'. Then the two assemblies may be mounted to the common metal shield 90i via the insulating baseplate 134. The two filters 130 and 130' may also be secured to each other as by an adhesive, not shown. The filter 30i gains the same advantages as the foregoing disclosed filters 30–30h.

Possible Modifications

Despite the foregoing detailed disclosure we do not wish our invention to be limited by the exact details of the illustrated embodiments. The following is a brief list of possible modifications or alterations of the foregoing embodiments which we believe all fall within the scope of our invention:

1. In connecting the bottom terminals of the capacitors to the conductive covering on the filter body as in the FIG. 16 filter 30c, the conductive grains may be charged into the resonance holes together with a solder paste attached thereto, instead of separately charging the conductive grains and the solder paste.

2. The conductive grains of the FIG. 16 filter 30c may be replaced by much smaller particles, with an average size of 10 microns or so, of copper or like conductive material. Other possible substitutes for the conductive grains are particles of the same ceramic material as the dielectric filter body with platings of copper or the like thereon, and particles, grains or pieces of iron or other metals.

3. Particles or other pieces of solder may be employed in place of solder paste for soldering the terminal connectors, conductive grains, etc.

4. The inventive concepts may be applied to half-wave distributed-constant filters in which the conductive covering is absent from the bottom end face of the filter body.

5. The pair of leads of each capacitor may be coupled to the electrodes via various means other than the metal caps.

6. The bottom lead of each capacitor may be dispensed with if the bottom metal cap is soldered to the conductive covering on the filter body via the connector, conductive grains, etc.

7. In the FIGS. 17 and 18 filter 30d, instead of obtaining capacitance by the conductive layers 114 on the circuit board 112, a pair of sheet metal pieces may be embedded in the insulating support 92d with a gap therebetween and may be connected to the top leads 66d.

8. The conductive grains and solder paste of the FIG. 16 filter 30c may be replaced by conductive grains with solder plating layer.

What we claim is:

1. A distributed-constant filter comprising:

(a) a dielectric filter body having a pair of opposite end faces, with a resonance hole extending through the filter body between the pair of end faces;

(b) a conductive covering formed on the filter body and including an inner portion formed on the surface of the filter body defining the resonance hole;

(c) a capacitor at least partly disposed in the resonance hole in the filter body, the capacitor comprising:

(1) a dielectric capacitor body;

(2) a first and a second electrode on the capacitor body;

(3) first terminal means connected to the first electrode and having a lead at least partly disposed outwardly of the resonance hole in the filter body; and (4) second terminal means connected to the second electrode and disposed in the resonance hole in the filter body; and (d) connector means disposed in the resonance hole in the filter body and electrically connecting the second terminal means of the capacitor to the inner portion of the conductive covering on the filter body.

2. The distributed-constant filter of claim 1 wherein the second terminal means comprises a second lead disposed in the resonance hole in the filter body and in collinear relation to the first recited lead of the first terminal means, the second lead being electrically connected to the inner portion of the conductive covering via the connector means.

3. The distributed-constant filter of claim 2 wherein the connector means comprises:

(a) a metal-made connector connected to the second lead; and (b) solder joining the connector to the inner portion of the conductive covering.

4. The distributed-constant filter of claim 3 wherein the connector integrally comprises:

(a) a first tubular portion fitted over the second lead; and (b) a second tubular portion concentrically joined to the first tubular portion, the second tubular portion being greater in diameter than the first tubular portion and closely engaged in the resonance hole in the filter body.

5. The distributed-constant filter of claim 4 wherein the second tubular portion of the connector has a plurality of notches formed therein and is resiliently pressfitted in the resonance hole in the filter body.

6. The distributed-constant filter of claim 2 wherein the connector means comprises:

(a) a plurality of conductive grains; and (b) solder joining the conductive grains and electrically connecting the second lead to the inner portion of the conductive covering via the conductive grains.

7. The distributed-constant filter of claim 2 wherein the second lead has an extension bent right-angularly therefrom, and wherein the connector means comprises solder joining the extension of the second lead to the inner portion of the conductive covering.

8. The distributed-constant filter of claim 2 wherein the first and second terminal means further comprise first and second metal caps, respectively, which are fitted over the first and second electrodes on the capacitor body, and wherein the first and second leads are connected to the first and second metal caps, respectively.

9. A distributed-constant filter comprising:

(a) a dielectric filter body having a pair of opposite end faces, with at least two resonance holes extending through the filter body between the pair of end faces;

(b) a conductive covering on the filter body including an inner portion formed on the surface of the filter body defining each resonance hole;

(c) at least two capacitors at least partly disposed in the respective resonance holes in the filter body, each capacitor comprising:

(1) a dielectric capacitor body;

(2) a first and a second electrode on the capacitor body;

(3) first terminal means connected to the first electrode and having a lead at least partly disposed outwardly of one associated resonance hole in the filter body; and (4) second terminal means connected to the second electrode and disposed in one associated resonance hole in the filter body; and (d) connector means disposed in each resonance hole in the filter body and electrically connecting the second terminal means of one associated capacitor to the inner portion of the conductive covering.

10. The distributed-constant filter of claim 9 further comprising means for mechanically interconnecting the capacitors for holding the same in prescribed positions relative to each other and to the filter body.

11. The distributed-constant filter of claim 9 further comprising a metal-made shield mounted to the filter body.

12. The distributed-constant filter of claim 9 further comprising:

(a) an insulating support mechanically interconnecting the capacitors and mounted to the filter body for holding the capacitors in prescribed positions relative to each other and to the filter body; and (b) a metal-made shield integrally combined with the insulating support.

13. The distributed-constant filter of claim 12 wherein the insulating support is formed to include portions enveloping the capacitors and received in the resonance holes in the filter body.

14. The distributed-constant filter of claim 12 wherein the filter body is boxlike in shape, having two pairs of opposite side faces in addition to the pair of opposite end faces, and wherein the metal-made shield comprises:

(a) a web overlying one of the opposite end faces of the filter body; and (b) a pair of side flanges extending in parallel spaced relation to each other from opposite sides of the web and held against one pair of opposite side faces of the filter body.

15. The distributed-constant filter of claim 14 wherein the conductive covering includes outer portions formed on the side faces of the filter body and electrically connected to the metal-made shield.

16. The distributed-constant filter of claim 14 wherein the metal-made shield further comprises a plurality of mounting lugs extending from the web in a direction away from the side flanges.

17. The distributed-constant filter of claim 12 further comprising means supported by the insulating support for providing capacitance between the leads of the first terminal means of the capacitors.

18. The distributed-constant filter of claim 17 wherein the means for providing capacitance comprises:

(a) a circuit board of insulating material supported by the insulating support; and (b) a pair of conductive regions formed on the circuit board, the conductive regions having a spacing therebetween and being connected respectively to the leads of the first terminal means of the capacitors.

19. The distributed-constant filter of claim 17 wherein the means for providing capacitance comprises:

(a) a capacitor element embedded in the insulating support; and (b) means electrically connecting the capacitor element to the leads of the first terminal means of the capacitors.

20. The distributed-constant filter of claim 9 wherein the filter body has an annular recess formed in one of the opposite end faces thereof so as to surround one end of each resonance hole, and wherein the conductive covering includes portions formed on the surfaces of the filter body defining the annular recesses.

21. The distributed-constant filter of claim 9 wherein the filter body has recesses extending along the edges of one of the opposite end faces thereof, and wherein the conductive covering includes portions formed on the surfaces of the filter body defining the recesses.

22. The distributed-constant filter of claim 9 wherein the filter body has three resonance holes in a row, and wherein the capacitors are disposed in the two outer ones of the three resonance holes.

23. A distributed-constant filter comprising:

(a) a dielectric filter body having a pair of opposite end faces, with first and second resonance holes extending through the filter body between the pair of end faces;

(b) a conductive covering on the filter body including inner portions formed on the surfaces of the filter body defining the first and second resonance holes;

(c) a first capacitor at least partly disposed in the first resonance hole in the filter body, the first capacitor comprising:

(1) a dielectric capacitor body;

(2) a first and a second electrode on the capacitor body;

(3) first terminal means connected to the first electrode and having a lead at least partly disposed outwardly of the first resonance hole; and (4) second terminal means connected to the second electrode and disposed in the first resonance hole;

(d) a second capacitor at least partly disposed in the second resonance hole in the filter body, the second capacitor comprising:

(1) a second dielectric capacitor body;
(2) a third and a fourth electrode on the second capacitor body;
(3) third terminal means connected to the third electrode and partly disposed outwardly of the second resonance hole; and
(4) fourth terminal means connected to the fourth electrode and disposed in the second resonance hole; and (e) connector means disposed in the first and second resonance holes in the filter body and electrically connecting the second terminal means of the first capacitor and the fourth terminal means of the second capacitor to the inner portions of the conductive covering.

24. A distributed-constsnt filter comprising:

(a) a dielectric filter body having a pair of opposite end faces and outsid surface, with a resonance hole extending through the filter body between the pair of end faces;
(b) an inner conductive covering formed on the inner peripheral face on the resonance hole;
(c) an outer conductive covering formed on the outside surface on the filter body;
(d) a capacitor at least partly disposed in the resonance hole in the filter body, the capacitor comprising:
(1) a dielectric capacitor body;
(2) a first and a second electrode on the capacitor body;
(3) first terminal means connected to the first electrode and having a lead at least partly disposed outwardly of the resonance hole in the filter body; and
(4) second terminal means connected to the second electrode and disposed in the resonance hole in the filter body; and
(e) connector means disposed in the resonance hole in the filter body and electrically connecting the second terminal means of the capacitor to the inner conductive covering.

25. A distributed-constant filter comprising:

(a) a dielectric filter body having a pair a of opposite end faces and four side faces, with at least two resonance holes extending through the filter body between the pair of end faces;
(b) inner conductive coverings formed on inner peripheral faces on the resonance holes;
(c) an outer conductive covering formed on the outside surface on the filter body;
(d) at least two capacitors at least partly disposed in the respective resonance holes in the filter body, each capacitor comprising:
(1) a dielectric capacitor body;
(2) a first and a second electrode on the capacitor body;
(3) first terminal means connected to the first electrode and having a lead at least partly disposed outwardly of one associated resonance hole in the filter body; and
(4) second terminal means connected to the second electrode and disposed in one associated resonance hole in the filter body; and
(e) connector means disposed in each resonance hole in the filter body and electrically connecting the second terminal means each capacitor to each inner conductive covering.

* * * * *